United States Patent [19]

Anschutz

[11] Patent Number: 4,987,702

[45] Date of Patent: Jan. 29, 1991

[54] SURFACING MACHINE

[75] Inventor: Wayne H. Anschutz, Topeka, Kans.

[73] Assignee: Seymour Foods, Inc., Topeka, Kans.

[21] Appl. No.: 264,904

[22] Filed: Oct. 31, 1988

[51] Int. Cl.[5] ..... B24B 31/02; B24B 1/00; D06F 37/02

[52] U.S. Cl. ..... 51/164.1; 51/73 R; 51/313; 15/3.2; 15/3.16

[58] Field of Search ..... 51/73 R, 164.1, 163.1, 51/289.5, 330, 334, 336, 358, 215 E, 215 M, 313; 15/3.16, 3.2, 3.21, 3.13, 181, 3.19

[56] References Cited

U.S. PATENT DOCUMENTS

| | | | |
|---|---|---|---|
| 1,031,832 | 7/1912 | Bohn | 51/164.1 X |
| 1,063,841 | 6/1913 | Stelter | 51/164.1 |
| 1,676,306 | 7/1928 | White | 15/3.2 X |
| 2,636,320 | 4/1950 | Knight | 51/215 M |
| 2,684,560 | 1/1952 | Swanson | 51/422 |
| 3,965,620 | 6/1976 | Dreher | 51/164.1 |
| 4,305,234 | 12/1981 | Pichelman | 51/358 |

*Primary Examiner*—William E. Terrell
*Assistant Examiner*—Bruce P. Watson
*Attorney, Agent, or Firm*—Litman, McMahon & Brown

[57] ABSTRACT

A surfacing machine for discrete objects includes a generally cylindrical drum with first and second ends, a longitudinal axis extending between the drum ends and a generally cylindrical, coaxial inner bore extending between and open at the ends. The drum bore has a surface defined by an abrasive material. A screw auger has first and second ends and is coaxially mounted within the drum bore. A drive system is drivingly connected to the drum and the screw auger and is adapted for counterrotating them. A noise and dust control system partially encloses the surfacing machine and a feed system feeds discrete objects to it.

24 Claims, 4 Drawing Sheets

10.
O.D.
I.D.

SURFACING MACHINE

BACKGROUND OF THE INVENTION

1. Field of the Invention

The present invention relates generally to surfacing machines and equipment, more particularly to machines and equipment for abrading the surfaces of discrete objects, and specifically to a machine for abrading the cores and unpainted covers of golf balls to prepare them for receiving layers of cover material and/or paint.

2. Description of the Prior Art

Various types of objects are surfaced as part of their manufacturing processes. Such surfacing procedures can include cleaning, sanding, brushing, sandblasting, media tumbling, etc. In some procedures the surfacing is intended to smooth the surfaces of the objects, while in other procedures it is intended to roughen them to provide better adhesion for a coat of paint or a layer material.

Objects with round, cylindrical and spherical configurations can be particularly difficult to surface because of the problems associated with matching a surfacing material to the surface configurations of such objects. Such difficulties have been encountered in the manufacture of golf balls. Generally golf balls are surface-treated at least once during their manufacture. Golf balls are commonly manufactured in either three-part (i.e. core, rubber windings and plastic cover), or two-part (i.e. elastomeric core and plastic cover) configurations. Cores for two-piece golf balls are commonly formed in molds comprising two halves that are alternately clamped together for receiving the molding material and separated for releasing the molded golf ball cores. A band of molding material, which is commonly referred to as "flashing", is typically formed around the molded cores where the two mold halves mate. The molded cores often have a relatively smooth surface, which is caused by the smoothness of the mold cavities.

Preparatory to applying a plastic cover, the molded cores generally must have their flashings removed and be roughened to achieve proper adhesion. For proper adhesion with a plastic cover, the core surfaces may be roughened with an abrasive material (e.g. sandpaper or the like) having a grit in the range of sixty to eighty. The plastic covers are also commonly roughened in preparation for painting, for example with abrasive material having a grit in the range of one hundred and eighty to two hundred and forty.

Among the various processes that have heretofore been employed for surfacing golf ball cores and unpainted golf balls are the following: (1) automated potato peelers; (2) sandblasting; (3) media tumbling; (4) corona discharge; (5) plasma; and (6) sandpaper drums. Some of the problems associated with these procedures include relatively high cost, excessive time consumption, material waste from grinding oversize cores down to size, inaccuracies and incomplete surfacing. Furthermore, some of these previous procedures involved "batch" processing of golf ball component lots and were thus somewhat incompatible with continuous, in-line manufacturing processes.

Heretofore there has not been available a surfacing machine with the advantages and features of the present invention.

SUMMARY OF THE INVENTION

In the practice of the present invention, a surfacing machine for discrete objects is provided which includes a frame assembly with front and back ends. A drum assembly has a generally cylindrical configuration with front and back ends and a coaxial bore extending between and open at the ends. The bore has an inner surface defined by an abrasive material. A screw auger assembly with front and back ends is coaxially mounted in the drum assembly bore. A drive system includes a motor which is drivingly connected to the drum and screw auger assemblies and which is adapted for counterrotating them. A noise and dust control system includes a housing for partially enclosing the surfacing machine and an exhaust fan for removing particles of abraded material. A feed system is provided for feeding discrete objects into the front end of the screw auger assembly.

OBJECTS AND ADVANTAGES OF THE INVENTION

The principal objects and advantages of the present invention include: providing a surfacing machine; providing such a machine which is adapted for surfacing discrete objects; providing such a machine which is adapted for surfacing spherical objects; providing such a machine which is adapted for surfacing golf ball cores and unpainted golf balls; providing such a machine which is adapted for continuous, in-line processing; providing such a machine which is adapted for removing flashing from and roughening the surfaces of golf ball cores; providing such a machine which minimizes material waste; providing such a machine which can employ either a wet or a dry surfacing procedure; providing such a machine which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 15 is a fragmentary, rear elevational view of the machine.

DETAILED DESCRIPTION OF THE PREFERRED EMBODIMENTS

I. Introduction

Figure 1:
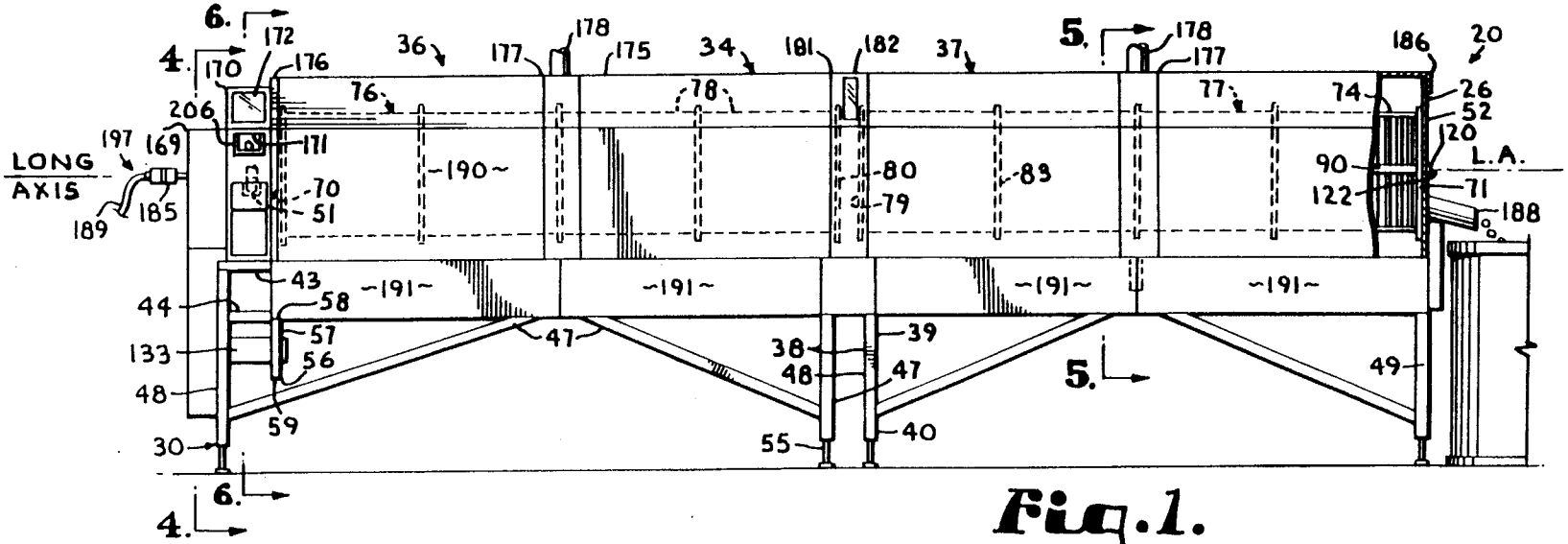
FIG. 1 is a side elevational view of a surfacing machine embodying the present invention.
Figure 2:
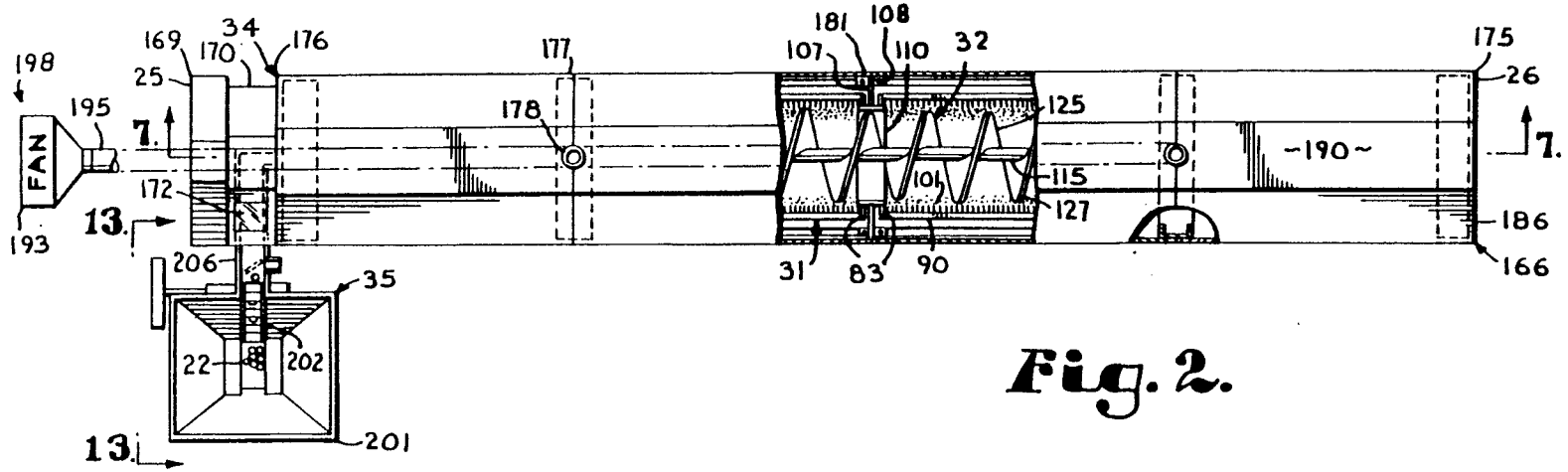
FIG. 2 is a top plan view of the machine.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 20 generally designates a surfacing machine embodying the present invention. Without limitation on the generality of useful applications of the present invention, the surfacing machine 20 is particularly designed for abrading golf ball cores 22 to prepare them to receive plastic covers and for abrading the plastic covers of unpainted golf balls in preparation for a painting step in the manufacturing process. The golf ball cores 22 in the form in which they are introduced into the surfacing machine 20 have relatively smooth outer surfaces 23 with annular mold flashing 24. Mold flashing, such as that shown at 24, commonly occurs when the golf ball cores 22 are molded in two-piece molds wherein each mold half forms a hemispherical cavity. Since mold halves sometimes do not fit together perfectly, an annular strip of flashing 24 can occur in the area of a plane containing the junction of the two mold halves.

The surfacing machine 20 has front and back ends 25, 26 and generally comprises a frame assembly 30, a drum assembly 31, a screw auger assembly 32, a drive system 33, a noise and dust control system 34, and a feed system 35.

II. Frame Assembly 30

The frame assembly 30 comprises front and back frame units 36, 37 each having front and back ends 48, 49 and four corner posts 38 with upper and lower ends 39, 40. Each frame unit 36, 37 includes a pair of upper longitudinal members 43 extending longitudinally between respective corner post upper ends 39 and a pair of lower longitudinal members 44 extending in parallel, spaced relation below the upper longitudinal members 43. Diagonal brace members 47 extend from the corner posts 38 in proximity to their lower ends 40 to connections approximately midway along respective lower longitudinal members 44. At its front end 48 the front frame unit 36 includes a front end subframe 51 and at its back end 49 the back frame unit 37 includes a back end subframe 52. The corner posts 38 may include threadably adjustable extensions 55 for leveling the frame assembly 30 and for accommodating supporting surfaces that are out of level.

A motor subframe 56 extends downwardly from the lower longitudinal members 44 of the front frame unit 36 in slightly spaced relation behind its front end 48. The motor subframe 56 includes a pair of vertical suspension members 57 with upper ends 58 connected to respective lower longitudinal members 44 and lower ends 59 connected by a motor crossbar 60. The motor subframe 56 thus has a U-shaped configuration. At the front and back ends 48, 49 of the frame units 36, 37, their longitudinal members 43, 44 are innerconnected by transverse upper and lower crossmembers 62, 63. The upper longitudinal members 43 are innerconnected by additional upper cross members 62 along their respective lengths. A motor crossmember 61 extends between the corner posts 38 of the front frame unit front end 48 in spaced relation below a respective lower cross member 63 at the approximate level of the motor crossbar 60.

The components of the frame assembly 30 may comprise various types of structural members, for example, steel angle iron. The frame assembly components may be suitably fastened, as by welding, bolting, riveting, etc.

III. Drum Assembly 31

The drum assembly 31 has a generally hollow cylindrical configuration with front and back ends 70, 71, a peripheral surface 74 and an inner surface 75 defining a bore 73. The drum assembly 31 comprises front and back drum units 76, 77 each comprising four innerconnected drum sections 78. Each drum unit 76, 77 includes front and back ends 79, 80.

Each drum unit 76, 77 includes five annular bands 83, two of which are located at respective drum unit front and back ends 79, 80 and the other three of which separate the four drum sections 78. Each band 83 includes front and back faces 84, 85 and inner and outer rims 86, 87. A longitudinal axis of rotation extends substantially through the center of the drum assembly 31 and through its ends 70, 71.

A plurality (e.g. six) of clamp strip subassemblies 90 extend along the peripheral surface 74 of each drum section 78 between respective bands 83. Each clamp strip subassembly 90 includes a plurality of clamp blocks 91 with pairs of transverse grooves 92 along inner edges thereof and transversely-spaced pairs of receivers 93 extending longitudinally between opposite faces thereof. The receivers are longitudinally aligned and receive clamp rods 94 with threaded ends 95. The rods 94 extend through corresponding receivers 96 which extend between the front and back band faces 84, 85. The bands 83 at the drum unit fronts and backs 76, 77 have six pairs of clamp rod receivers 96 spaced at approximately sixty degree intervals along the annular band faces 84, 85.

The clamp strip subassemblies 90 of adjacent drum sections 78 are staggered with respect to each other to provide access to the threaded rod ends 95. Thus, each band 83 between a respective pair of drum sections 78 includes twelve pairs of band receivers 96 spaced at approximately thirty degree intervals along the annular band front and back faces 84, 85. The rod threaded ends 95 threadably receive nuts 97 which may be tightened against their respective faces 84, 85 for compressing the clamp strip subassemblies 90.

Figure 11:
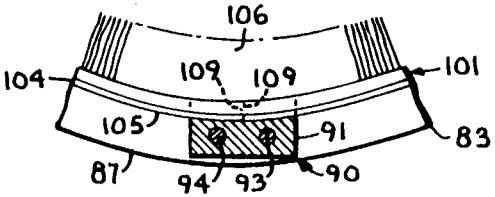
FIG. 11 is an enlarged, fragmentary, cross-sectional view of the machine taken generally along line 11—11 in FIG. 9 and particularly showing a brush subassembly thereof.

Each drum unit 76, 77 includes a respective brush subassembly 101 forming abrasion means. The brush subassemblies 101 have generally cylindrical configurations and may be formed from a plurality of annular, parallel, juxtaposed brush rings 104. Each brush ring 104 includes a circular spine member 105 with an inwardly-open, channel-shaped cross section. Bristles 106 are imbedded in the spine member 105 and may comprise, for example, a nylon binder impregnated with silicon carbide particles. However, various other types of bristles, e.g. steel wire, and other abrasive means may be used in place of the bristles 106 and the brush rings 104. Each brush ring 104 is mounted in a respective drum unit 76 or 77 by placing its spine member in the grooves 92 of corresponding pairs of clamp blocks 91. Each brush ring 104 includes a pair of opposed and/or abutting ends 109 whereat the spine member is preferably captured in the grooves 92 of a respective pair of clamp blocks 91 (FIG. 11). With the brush rings 104 in place, their bristles 106 project radially inwardly to form the inner surface 75 of the drum assembly 31.

Suitable brush rings 104 are available from the Industrial Brush Corporation of Pomona, California, and may be spaced at various desired intervals, for example, one inch. The brush bristles 106 may be packed relatively tightly and the brush rings 104 may be relatively close together so that the drum assembly inner surface 75 is somewhat uniform and continuous for a relatively high degree of abrading contact between the bristles 106 and the golf ball cores 22. However, the drum assembly 31 and the brush subassemblies 101 are relatively porous and permit the flow of air and airborne core material particles therethrough.

Between the drum units 76, 77 a pair of guides 107 are provided, each having a base 108 mounted on a respective upper longitudinal member 43 and an arcuate strip 110 which is positioned slightly radially inwardly in an overlapping relation with respect to the front drum unit back end 80 and the back drum unit front end 79. The guides 107 function to maintain the cores 22 in place to prevent them from escaping the drum assembly 31 between the front and back drum units 76, 77.

IV. Screw Auger Assembly 32

The screw auger assembly 32 includes opposite front and back ends 111, 112 and a longitudinally-extending coaxial tube 115 with front and back ends 116, 117 recessed behind and in front of the screw auger assembly front and back ends 111, 112 respectively. A coaxial auger drive shaft 120 extends longitudinally and includes front and back ends 121, 122, which project from the respective coaxial tube front and back ends 116, 117. The auger drive shaft ends 121, 122 are rotatably received in respective front and back auger bearings 128, 129 mounted on the front and back end subframes 51, 52 respectively.

A helical screw flight 125 includes an inner margin 126 fixedly connected, e.g. by welding, to the coaxial tube 115 and an outer margin 127 defining an outside diameter O.D. for the screw auger assembly 32. The screw auger assembly 32 has a single flight 125, but screw augers with multiple flights could also be employed with the present invention. The screw auger assembly 32 may be designed to continuously span the distance through the drum assembly 31. Alternatively, screw augers could be provided which would be supported at one or more intermediate areas along their respective lengths.

V. Drive System 33

The surfacing machine 20 is provided with a common drive system 33 for simultaneously counterrotating the drum assembly 31 and the screw auger assembly 32. The drive system 33 comprises a motor (e.g. electric) 133 which may be connected to a suitable power source (not shown). The motor 133 is mounted on the motor crossbar 60 of the motor subframe 56 and the motor crossmember 61. The motor 133 includes a pulley 134.

A gear reduction unit 138 with a back pulley 139 is mounted on the lower cross member 63 at the front frame unit front end 48. A gear reduction unit sprocket 142 is mounted on the front of the gear reduction unit 138. A screw auger sprocket 143 is keyed to the auger drive shaft front end 121 and is drivingly connected to the gear reduction unit sprocket 142 by an endless drive chain 144. The screw auger sprocket 143 is larger than the gear reduction unit sprocket 142 whereby the angular velocity or rotational speed is decreased and the torque is increased from the gear reduction unit 138 to the screw auger assembly 32.

The drum assembly 31 is drivingly supported on a pair of longitudinally-extending drum drive subassemblies 150. Each drum drive subassembly 150 includes a shaft 151 with front and back ends 152, 153. The shafts 151 may be continuous or may comprise multiple segments joined together. For example, the shafts 151 could comprise two parts each joined approximately midway along the drum assembly 31 between the front and back drum units 76, 77.

Each shaft 151 is journaled in a plurality of longitudinally aligned pillow block bearings 155 mounted on the frame upper cross members 62. A plurality of drum drive wheels 156 are keyed to each shaft 151 and comprise rubber rollers 157 with annular perimeters 158. The rubber rollers 157 are fixedly connected to retainer flanges 159 with outer margins 160 which extend radially outwardly from the roller perimeters 158. The rollers 157 preferably comprise a material with a relatively high coefficient of friction, such as hard rubber, and the retainer flanges 159 may comprise a material with a relatively low coefficient of friction, e.g. high molecular weight (HMW) plastic. Each roller perimeter 158 drivingly and supportingly engages a respective band outer rim 87. Thus, the surfacing machine 20 of the present invention may include one drive wheel 156 on each drive shaft 151 for each drum assembly band 83 for a total of twenty drive wheels 156 driving and supporting ten drum assembly bands 83.

Figures 3, 4, 5, 13A:
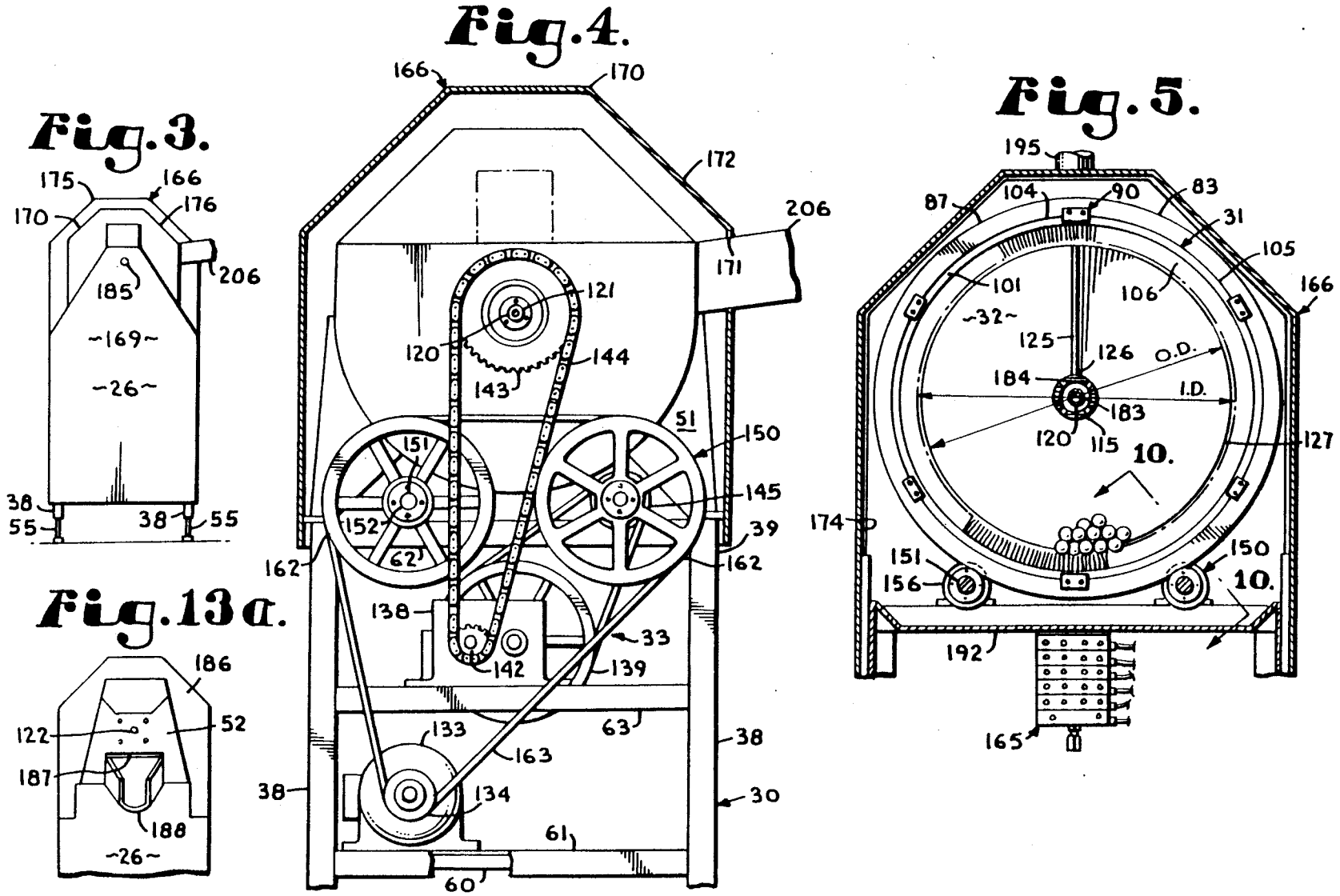
FIG. 3 is a fragmentary, front elevational view of the machine.
FIG. 4 is an enlarged, fragmentary, cross-sectional view of the machine taken generally along line 4—4 in FIG. 1 and particularly showing a drive system.
FIG. 5 is an enlarged, vertical, cross-sectional view of the machine taken generally along line 5—5 in FIG. 1.

The drive shaft bearings 155 are preferably located in proximity to the drive wheels 156 and thus provide support for the drive shafts 151 near the areas where they are subjected to the greatest loading, i.e. at the drive wheels 156 which bear a large portion of the weight of the drum assembly 31 and the golf ball cores 22 contained therein. A lubrication system 165 is mounted on the frame assembly 155 and communicates with the bearings 128, 129 and 155 for automatically lubricating them (FIG. 5).

The drive shaft front ends 152 mount respective drive shaft pulleys 162 which are drivingly connected to the motor pulley 134 by an endless drive belt 163 reeved over the drive shaft pulleys 162 and the motor pulley 134. A drive pulley 145 is mounted on one of the drive shafts 151 behind a respective drive shaft pulley 162 and is drivingly connected to the back pulley 139 on the back of the gear reduction unit 138. The drive pulley 145 has a smaller diameter than the gear reduction unit back pulley 139 whereby the gear reduction unit back pulley 139 is rotated with greater torque and with less angular velocity than the drive shaft 151.

VI. Noise and Dust Control System 34

In operation with a full load of golf ball cores 22, substantial sound may be generated by the drive system 33 and by the drum assembly 31 and the screw auger assembly 32 impacting with the golf ball cores 22. Furthermore, the abrading action of the brush subassemblies 101 can generate waste matter in the form of dust. The noise and dust control system 34 includes a housing assembly 166 for substantially controlling both noise and dust emissions. The housing assembly 166 includes a drive train housing 169 mounted on the front frame unit front end 48 in covering relation over the motor 133, the gear reduction unit 138 and other portions of the drive system 33. An inlet housing 170 is placed over the screw auger front end 111 and includes an inlet opening 171 and an inspection window 172. A drum assembly housing 175 is mounted over the drum assembly 31 and includes a front panel 176 connected to the drive train housing 169 and associated with the drum assembly front end 70. The drum housing 175 also includes a pair of outlet sections 177 each located approximately midway along a respective drum unit 75 or 76 and including a top-mounted outlet 178. A middle section 181 is placed over the area between the drum units 75, 76 and includes an inspection window 182. A back panel 186 is mounted on the frame assembly back end 49 and includes an outlet opening 187 which receives an outlet chute 188 communicating with the screw auger back end 112.

A plurality (e.g. four) of drum assembly panels 190 are mounted between the front panel 176, the outlet sections 177, the middle section 181 and the back panel 186 and each substantially covers a respective pair of drum sections 78. The drum assembly panels 190 may be mounted on and extend upwardly from the upper longitudinal members 43 of the frame assembly 30. A plurality of inspection panels 191 may be mounted on the frame assembly 30 between the upper and lower longitudinal members 43, 44 below the drum assembly panels 190. Each inspection panel 191 may be hingedly connected to a respective lower longitudinal member 44.

The housing assembly components 169, 170, 176, 177, 181, 186, 190 and 191 may comprise any suitable material, e.g. sheet metal, and may be fastened to the frame assembly 30 by suitable mechanical fasteners, e.g. screws, clips, rivets, etc. Such components may be designed for easy removal for servicing the surfacing machine 20. The components of the housing assembly 166 may also be provided with insulation 174 for sound control.

The surfacing machine 20 can be employed for either a "wet" or a "dry" surfacing process. For a wet surfacing process the noise and dust control system 34 includes a water bore 183 extending coaxially through the screw auger drive shaft 120 from its front end 121. A plurality of water outlet orifices at the surface of the coaxial tube 115 communicate fluidically with the water bore 183. The screw auger front end 111 mounts a rotary coupling 185 which fluidically communicates with the water bore 183 and with a water conduit 189, which may be connected to a suitable water source (not shown). A plurality of bottom pans 192 are mounted on the frame assembly 30 at approximately the level of the lower longitudinal members 44. The bottom pans 192 are adapted for receiving waste water and include drains 196 which may fluidically communicate with a waste water drainage system. The water bore 183, the water outlet orifices 184, the rotary coupling 185, the water conduit 189 and the bottom pans 192 collectively comprise a rinse subsystem 197.

An exhaust air subsystem 198 includes an exhaust fan 193 which is connected to the outlet openings 187 by a suitable air outlet duct 195.

VII. Feed System 35

Figure 13:
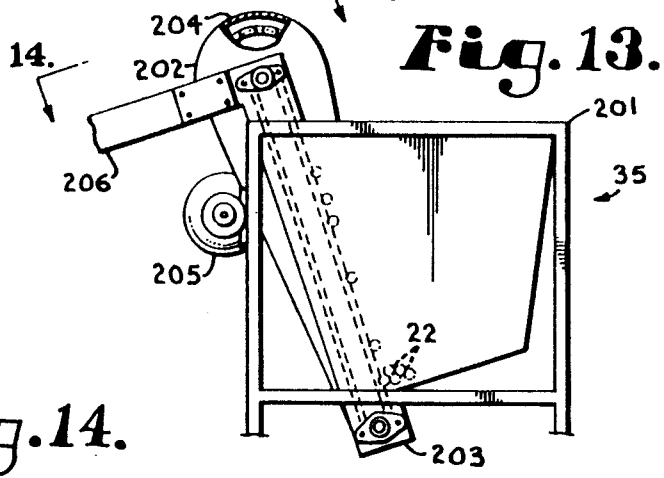
FIG. 13 is an enlarged, fragmentary, front elevational view of a feed system of the machine taken generally along line 13—13 in FIG. 2.
Figure 14:
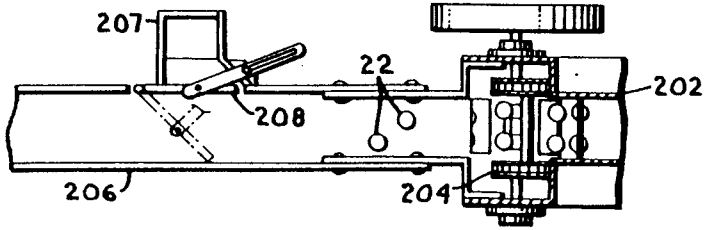
FIG. 14 is an enlarged, fragmentary, top plan view of the machine particularly showing a portion of the feed system thereof and taken generally along line 14—14 in FIG. 13.
Figure 6:
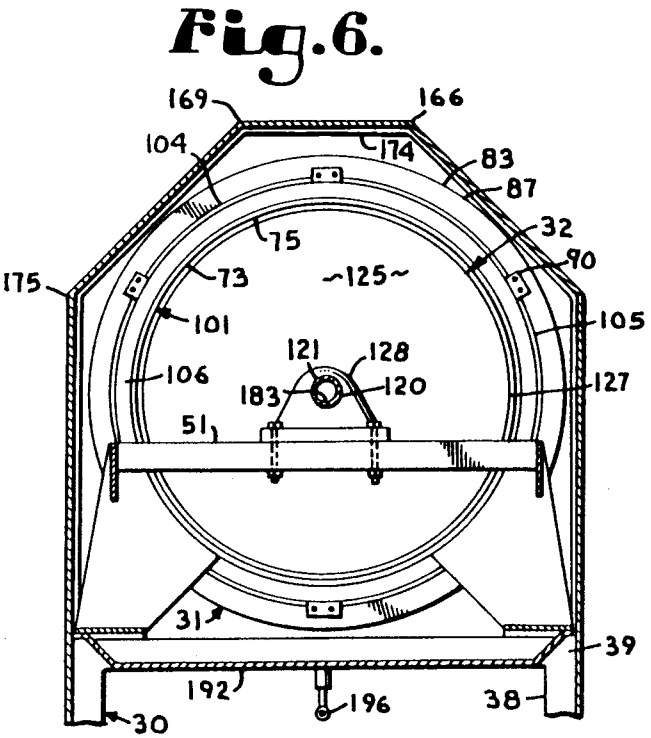
FIG. 6 is an enlarged, vertical, cross-sectional view of the machine taken generally along line 6—6 in FIG. 1.
Figure 12:
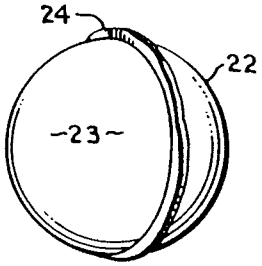
FIG. 12 is a perspective view of a golf ball core shown prior to surfacing.
Figure 7:
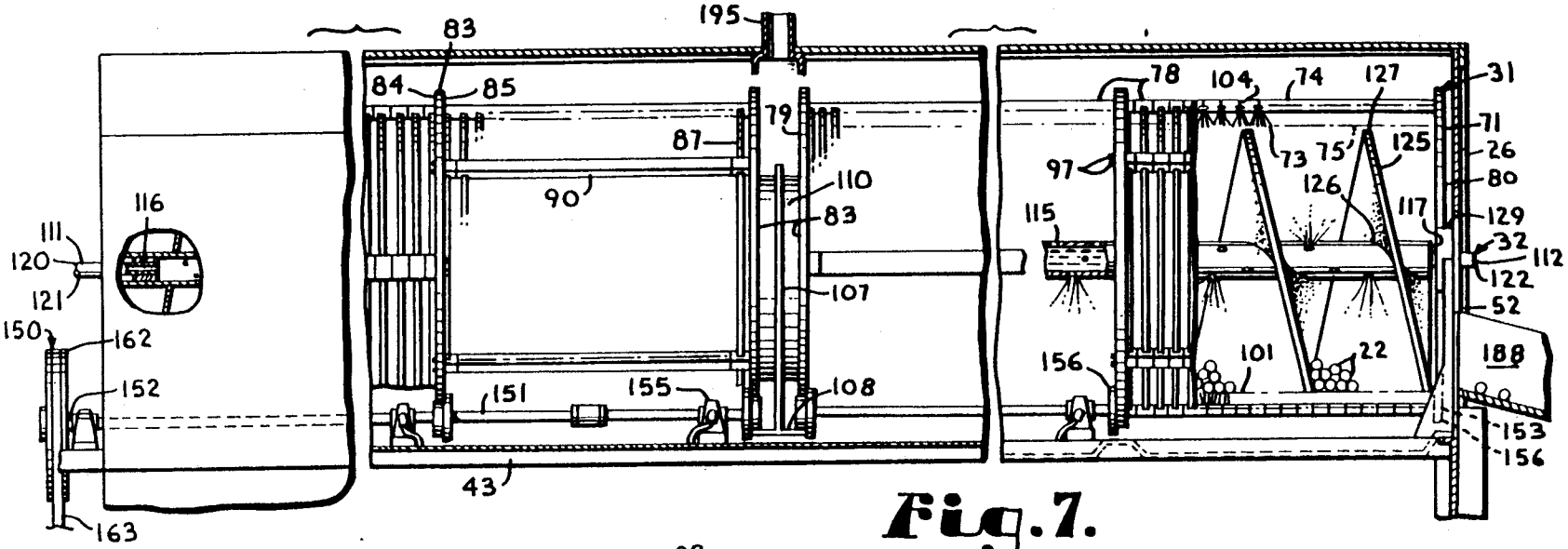
FIG. 7 is an enlarged, fragmentary, longitudinal, cross-sectional view of the machine taken generally along line 7—7 in FIG. 2.
Figure 10:
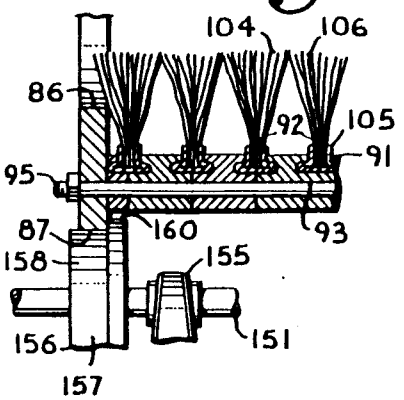
FIG. 10 is an enlarged, fragmentary, cross-sectional view of the machine taken generally along line 10—10 in FIG. 5.
Figure 9:
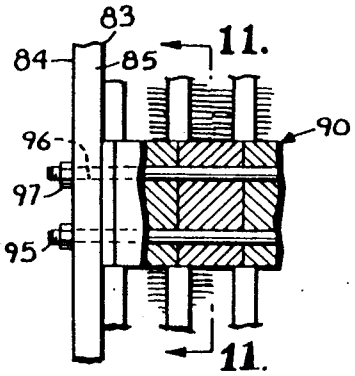
FIG. 9 is an enlarged, fragmentary view of the machine particularly showing a portion of a clamp strip subassembly thereof.
Figure 8:
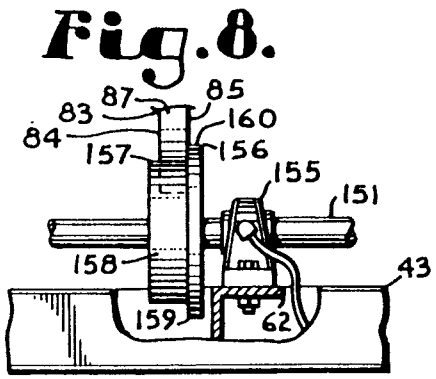
FIG. 8 is an enlarged, fragmentary, side elevational view of the machine particularly showing a portion of a drum drive subassembly thereof.

The feed system 35 includes a hopper 201 for containing a supply of golf ball cores 22 or unpainted golf balls (FIG. 13). An endless belt conveyor 202 extends from a lower end 203 in proximity to a bottom of the hopper 201 to an upper end 204 and is driven by a motor 205. A feed chute 206 is mounted on the feed system 35 for receiving objects from the conveyor upper end 204 and extends to the inlet opening 171. A diverter chute 207 communicates with the feed chute 206. The output of the conveyor 202 may be diverted to the diverter chute 207 by means of a diverter flap 208 with a feed position blocking the diverter chute 207 for directing objects to the inlet 170 and a divert position with the feed chute 206 blocked for diverting objects to the diverter chute 207.

VIII. Operation

In operation, the surfacing machine 20 may be adapted for surfacing various discrete objects, such as golf ball cores 22 in preparation for covering or unpainted golf balls in preparation for painting. The workpieces or objects are conveyed from the feed hopper 201 by the conveyor 202 and discharged to a feeder chute 206. If the surfacing machine 20 is overloaded or if defective cores 22 are encountered, the diverter flap 208 may be placed in its divert position to divert such cores 22 to the diverter chute 207 for recycling, discarding, etc. Sometimes irregular balls are encountered and may be completed and marketed as such, but it may be desirable to separate them from the remainder of the production in the manner described.

With the diverter flap 208 in its feed position, the cores 22 enter the inlet 170 from the feeder chute 206 and are propelled along the length of the drum assembly 31 by the screw auger assembly 32. The inner surface 75 of the drum assembly 31 preferably has an inside diameter I. D. slightly larger than an outside diameter O. D. of the screw auger assembly 32. For example, the drum assembly 32 may have an inside diameter I. D. (measured between the tips of the bristles 106) of approximately twenty inches and the screw auger assembly 32 may have an outside diameter O. D. of approximately nineteen inches, for about one-half inch of annular clearance therebetween.

The drive system 33 is adapted for counterrotating the drum assembly 31 and the screw auger assembly 32. The screw auger assembly 32 may be rotated at a much lower speed than the drum assembly 31, for example about one revolution for every three and one-half minutes for the screw auger assembly 32 and about sixty revolutions per minute for the drum assembly 31. For a surfacing machine 20 with a drum assembly length of about sixteen feet, the total travel time through the drum assembly may be approximately one-half hour.

As the cores 22 advance through the drum assembly 31, their mold flashings 24 are ground off and their smooth surfaces 23 are abraded by the action of the bristles 106. The counterrotation of the drum assembly 31 and the screw auger assembly 32 turns the cores 22 so that relatively complete abrasion is achieved. In particular, such counterrotation functions to reduce the likelihood that the cores 22 will travel completely through the drum assembly 31 in a particular orientation whereby flat spots might be ground onto them.

The bristles 106 with silicon carbide particles tend to be relatively long wearing and are particularly well adapted for effectively abrading the core surfaces 23 and for grinding off the mold flashings 24.

During the abrasion process, dust particles from the cores 22 may be generated. The noise and dust control system 34 is adapted for flushing or exhausting a substantial portion of the dust particles. With the exhaust air subsystem 198 in operation, ambient air enters the machine 20 through its ends. The dust-laden air is then exhausted through the outlet duct 195.

Alternatively or in combination with the exhaust air system 198, it may be desirable to flush particles from the machine 20 with the rinse subsystem 197. In particular, it may be desirable to rinse particles from the surfacing machine 20 so that particles from a batch of unpainted balls having one color do not tint the unpainted balls of a batch having another color. The rinse subsystem 197 is operated by introducing a rinse liquid, e.g. water, into the screw auger water bore 183. From the water bore 183 the rinse liquid may be distributed throughout the drum bore 73 for cleaning the screw auger assembly 32, the drum assembly 31 and the golf ball cores 22 or the unpainted golf balls. The rinse liquid laden with the particles is collected in the bottom pans 192 for discharge through the drains 196.

The surfacing machine 20 may be provided with either the rinse subsystem 197 or the exhaust air subsystem 198 or both. If the rinse subsystem 197 is provided, it may be preferable to fabricate many of the metal components of the machine 20 from a rust and corrosion resistant material, e.g. stainless steel.

It is to be understood that while certain forms of the present invention have been illustrated and described herein, it is not to be limited to the specific forms or arrangement of parts described and shown.

What is claimed and desired to be secured by Letters Patent is as follows:

1. A surfacing machine for discrete objects, which comprises:

(a) front and back ends;

(b) a longitudinal axis extending between said ends;

(c) a generally coaxial, cylindrical drum having:

(1) front and back ends;

(2) a bore extending between and open at said ends, said bore including an inner surface;

(3) an outer, cylindrical surface; and (4) surfacing means comprising a plurality of annular bands of bristles, said bristles being fixedly connected together at said drum and extending radially inwardly and forming said drum bore inner surface;

(d) a generally coaxial screw auger extending at least partly through said drum bore and having front and back ends;

(e) frame means mounting said drum said screw auger for rotation generally about said longitudinal axis; and (f) drive means drivingly connected to and adapted for rotating said drum and said screw auger.

2. The machine according to claim 1 wherein:

(a) said bristles include silicon carbide particles.

3. The machine according to claim 1 wherein said drum includes:

(a) clamp means extending longitudinally along said drum outer surface in parallel, spaced relation to said longitudinal axis, said clamp means being adapted for clamping said bands.

4. The machine according to claim 3 wherein said clamp means include:

(a) a plurality of spacer blocks each positioned between a respective adjacent pair of bands; and (b) a rod extending longitudinally through said blocks and adapted for securing said blocks together.

5. The machine according to claim 1 wherein said drive means includes:

(a) a transversely-spaced pair of rollers each having a rotational axis extending longitudinally;

(b) each said roller engaging said drum in supporting relation; and (c) at least one of said rollers being driven by said drive means.

6. The machine according to claim 5, which includes:

(a) a pair of drum drive shafts each rotatably mounted on said frame means and mounting a respective roller; and (b) each said drum drive shaft extending along a respective rotational axis.

7. The machine according to claim 1 which includes:

(a) a housing at least partially enclosing said drum; and (b) air circulation means associated with said housing and adapted for drawing an air current through said machine.

8. The machine according to claim 7 wherein said air circulation means includes:

(a) an opening in said housing; and (b) fan means connected to said housing in communication with said opening.

9. A surfacing machine for discrete objects, which comprises:

(a) front and back ends;

(b) a longitudinal axis extending between said ends;

(c) a generally coaxial, cylindrical drum having:

(1) front and back ends;

(2) a bore extending between and open at said ends, said bore having an inner surface; and (3) a brush subassembly including a plurality of bristles extending radially inwardly and forming said bore inner surface;

(d) a generally coaxial screw auger extending at least partly through said drum bore and having front and back ends;

(e) frame means mounting said drum and said screw auger for rotation generally about said longitudinal axis; and (f) drive means drivingly connected to and adapted for counterrotating said drum and said screw auger.

10. A surfacing machine for discrete objects, which comprises:

(a) front and back ends;

(b) a longitudinal axis extending between said ends;

(c) a generally coaxial, cylindrical drum having:

(1) front and back ends;

(2) a bore extending between and open at said ends, said bore including an inner surface;

(3) a brush subassembly including an outer, cylindrical surface and a plurality of annular rings of bristles, said bristles being fixedly connected together at said drum and extending radially inwardly and forming said bore inner surface;

(d) a generally coaxial screw auger extending at least partly through said drum bore and having front and back ends;

(e) frame means mounting said drum and said screw auger for rotation generally about said longitudinal axis; and (f) drive means drivingly connected to and adapted for counterrotating said drum and said screw auger.

11. The machine according to claim 10 wherein said brush subassembly includes:

(a) clamp means extending longitudinally along said brush outer surface in parallel, spaced relation to said longitudinal axis, said clamp means being adapted for clamping said rings.

12. The machine according to claim 11 wherein said clamp means includes:

(a) a plurality of spacer blocks each positioned between a respective adjacent pair of rings; and (b) a rod extending longitudinally through said blocks and adapted for securing said blocks together.

13. The machine according to claim 12 wherein said brush subassembly includes:

(a) a pair of generally coaxial, annular bands positioned in longitudinally spaced relation;

(b) said brush rings being positioned between said annular bands; and (c) said clamp means extending between said bands with said rod connected thereto.

14. The machine according to claim 13 wherein said drive means includes:

(a) a transversely-spaced pair of drum drive subassemblies each having a longitudinally-extending rotational axis;

(b) each said drum drive subassembly including a shaft extending along a respective rotational axis;

(c) each said drum drive subassembly having a pair of drive wheels mounted on said shaft;

(d) each said band engaging a transversely-spaced pair of said drive wheels; and (e) at least one of said drum drive subassemblies being driven by said drive means.

15. The machine according to claim 14 wherein:

(a) said drum assembly includes a plurality of drum sections and a plurality of bands each located at a respective drum section end; and (b) each said drum drive subassembly includes a plurality of said drive wheels each engaging a respective band.

16. The machine according to claim 10 wherein said drive means includes:

(a) a motor mounted on said frame means;

(b) means drivingly connecting said motor to said drum assembly; and (c) gear reduction means drivingly connecting said screw auger to said motor, said gear reduction means being adapted for rotating said screw auger at a lower angular velocity than said drum assembly.

17. The machine according to claim 10, which includes:

(a) an inlet associated with its front end;

(b) an outlet associated with its back end; and (c) a feed system including a feed hopper for receiving said discrete objects and a conveyor for conveying said objects from said hopper to said machine inlet.

18. The machine according to claim 17 wherein said feed system includes:

(a) a feed chute extending from said conveyor to said inlet;

(b) a diverter chute extending from said feed chute; and (c) a diverter flap having a feed position adapted for passing said discrete objects from said conveyor to said inlet and a divert position adapted for passing said discrete objects from said conveyor to said diverter chute.

19. The machine according to claim 10 which includes:

(a) rinse means adapted for rinsing said drum assembly.

20. The machine according to claim 19 wherein said rinse means includes:

(a) a bore extending coaxially through at least a portion of said screw auger and adapted for fluidically coupling to a rinse liquid source; and (b) an outlet orifice in said screw auger communicating with said screw auger bore for dispensing said rinse liquid onto said drum assembly; and (c) collection means adapted for collecting said rinse liquid.

21. The machine according to claim 10 which includes:

(a) a housing at least partially enclosing said drum and having an outlet opening; and (b) fan means connected to said housing opening and adapted for drawing an air current through said machine.

22. A surfacing machine for discrete objects, which comprises:

(a) front and back ends;

(b) a longitudinal axis extending between said ends;

(c) a frame assembly;

(d) a generally coaxial, cylindrical drum assembly having:

(1) front and back ends;

(2) a bore extending between and open at said ends, said bore having an inner surface;

(3) a plurality of generally coaxial bands each having inner and outer rims;

(4) a plurality of generally coaxial brush rings positioned in juxtaposed relation between respective pairs of said bands, each said brush ring having an outer spine member and a plurality of bristles extending radially inwardly from said spine member, said bristles defining said drum bore inner surface; and (5) a plurality of clamp means extending longitudinally in parallel, spaced relation to said longitudinal axis, each said clamp means comprising a plurality of spacer blocks each positioned at least partly between a respective adjacent pair of rings, and each said clamp means including a pair of rods extending longitudinally through said blocks and connected to a respective pair of said bands whereby said blocks and said brush ring spine members are clamped together;

(e) a generally coaxial screw auger extending at least partly through said drum bore and having front and back ends;

(f) frame means mounting said drum and said screw auger for rotation generally about said longitudinal axis;

(g) drive means including:

(1) a motor mounted on said frame means;

(2) a pair of drum drive subassemblies each mounted on said frame assembly and extending longitudinally along a rotational axis in parallel, spaced relation to said longitudinal axis, each said drum drive subassembly including a coaxial drive shaft and a plurality of drive wheels mounted on said drive shaft and each drivingly and supportingly engaging a respective drum assembly band;

(3) drive means innerconnecting said motor and at least one of said drum drive subassemblies;

(4) a gear reduction unit drivingly innerconnecting said motor and said screw auger for counterrotating said screw auger with a lower angular velocity with respect to said drum assembly;

(h) a noise and dust control system including:

(1) a rinse subsystem including a water bore extending through said screw auger and adapted for fluidically communicating with a water source, said rinse subsystem including a plurality of outlet orifices in said screw auger each fluidically communicating with said rinse liquid bore and adapted for discharging said rinse liquid onto said drum assembly;

(2) a housing assembly at least partly enclosing said drum assembly and having inlet and outlet openings; and (3) an exhaust air subsystem including an exhaust fan fluidically connected to said housing opening and adapted for discharging air and dust particles therethrough; and (i) a feed system including a feed hopper adapted to receive said discrete objects, a conveyor adapted for conveying discrete objects from said hopper and a feed chute adapted for passing discrete objects from said conveyor to said inlet opening.

23. A surfacing machine for discrete objects, which comprises:

(a) front and back ends;

(b) a longitudinal axis extending between said ends;

(c) a generally coaxial, cylindrical drum having:

(1) front and back ends;

(2) a bore extending between and open at said ends, said bore including an inner surface;

(3) a plurality of discrete brush assemblies with bristles extending radially inwardly and forming said bore inner surface; and (4) brush assembly connecting means connecting said brush assemblies together with multiple particle passages formed between said connected brush assemblies;

(d) a generally coaxial screw auger extending at least partly through said drum bore and having front and back ends and a flight with an outer margin positioned in spaced relation inwardly from said drum bore inner surface whereby a cylindrical clearance space is formed between said screw auger flight outer margin and said drum bore inner surface;

(e) frame means mounting said drum and said screw auger for rotation generally about said longitudinal axis; and (f) drive means drivingly connected to and adapted for differentially rotating said drum and said screw auger.

24. The machine according to claim 23 wherein said drum includes:

(a) an outer, cylindrical surface; and (b) a plurality of annular bands of said bristles, said bristles being fixedly connected together at said drum outer surface.

* * * * *